United States Patent [19]

Trame

[11] 4,095,359

[45] Jun. 20, 1978

[54] TAPE HOLDING MECHANISM FOR DISPLAY DEVICE

[75] Inventor: Charles Edward Trame, Mequon, Wis.

[73] Assignee: Everbrite Electric Signs, Inc., South Milwaukee, Wis.

[21] Appl. No.: 755,713

[22] Filed: Dec. 30, 1976

[51] Int. Cl.[2] ..... G09F 11/24

[52] U.S. Cl. ..... 40/446; 40/10 R; 40/18; 40/518

[58] Field of Search ..... 40/86 R, 86 A, 31, 10 R, 40/18, 17

[56] References Cited

U.S. PATENT DOCUMENTS

| | | | |
|---|---|---|---|
| 1,553,906 | 9/1925 | Marette | 40/86 A |
| 1,890,117 | 12/1932 | Jeffreys | 40/86 R X |
| 1,999,133 | 4/1935 | Shapiro | 40/86 A |
| 2,588,803 | 3/1952 | Coffey | 40/86 A |
| 2,951,301 | 9/1960 | Slavsky | 40/17 |
| 3,100,356 | 8/1963 | Offensend et al. | 40/17 |
| 3,939,584 | 2/1976 | Trame | 40/10 R |

*Primary Examiner*—John F. Pitrelli
*Attorney, Agent, or Firm*—Ralph G. Hohenfeldt

[57] ABSTRACT

In a display device, a precoiled plastic tape bearing informational indicia runs over a back-up surface to present the front side of the tape for observation and for manual access to enable translating the tape. The tape also runs over stationary pins which allow the tape to coil when translated in one direction. Opposed ends of the tape are provided with apertures which are entered by the pins when one end portion of the tape is nearly uncoiled so that further translation and complete uncoiling of the tape is prevented. The tape end portion is automatically disengaged from the pins by the inherent coil forming stress in the tape when reverse translation is initiated.

4 Claims, 8 Drawing Figures

TAPE HOLDING MECHANISM FOR DISPLAY DEVICE

BACKGROUND OF THE INVENTION

This invention relates to displays or signs wherein indicia such as prices of items in a store or on a menu are presented for observation. More specifically, the invention is concerned with improvements in the type of display wherein numerals or letters of the alphabet are fixed on a precoiled plastic tape.

A display device using tape is exemplified in U.S. Pat. No. 3,939,584, dated Feb. 24, 1976, and assigned to the assignee of this application. The embodiment shown in FIG. 9 of the cited patent is typical of the kind of display device to which the present improvements apply.

In display devices wherein information to be displayed is represented by translucent areas bounded by opaque areas on a tape, the tape is translated over a convex translucent surface such that the rear side of the tape may be, but does not necessarily have to be, exposed to a light source and the front side of the tape may be exposed for observation. The tape is prestressed or precoiled so it desirably has a tendency to wind itself into a coil if left unrestrained. By proper guidance, the tape may be caused to follow a path before and after it passes over the translucent surface which permits opposite ends of the tape to coil. In prior display devices of the type here under consideration and in the improved device, the tape is translated to present consecutive indicia by applying pressure with the fingers and simultaneously exerting a translational force on the front surface of the tape. However, since the opposite end portions of the tape which are coiling and uncoiling, respectively, are not usually visible to the operator, there are occasions when translating or winding of the tape is carried on to the extent that one uncoiling end of the tape is set free. This results in a single coil being formed and requires that the leading end of the tape be rethreaded into the holder which is a time consuming operation.

SUMMARY OF THE INVENTION

A general object of the present invention is to provide a device, that uses tape to display indicia, with means that automatically engages and stops the end portion of the tape when that end portion is almost completely uncoiled so as to prevent complete removal of the tape, but on the other hand, permits unimpeded and guided translation and rewinding of the coil in the opposite direction.

A more specific object of the invention is to provide a tape end portion engaging mechanism which is simple in construction, has no moving parts and which relies on the inherent force of a precoiled tape to effect engagement and disengagement of the end of the tape.

Briefly stated, the improved display device is characterized by use of a component which has spaced apart sides that are joined by a convexly shaped light transmissive material which provides a surface on which the displayed indicia is positioned by the tape which is superimposed on it. Opposite ends of the tape run over the side members of the component so that the coils at opposite ends of the tape may be formed adjacent the ends of the side members. In the improved device, however, pin means or lugs project into contact relation normally with the inner or rear surface of the tape. The tape is also provided at opposite ends with apertures that are engageable by the pins when the tape is nearly uncoiled at one end in which case the tape is restrained against further translation and uncoiling. When a manual force is applied in a direction for recoiling the same end of the tape, the tape automatically releases itself from the projecting pins to permit uninhibited recoiling.

The manner in which the aforementioned objects of the invention and other more specific objects are achieved will be evident in the more detailed description of an illustrative embodiment of the invention which will now be set forth in reference to the drawings.

DESCRIPTION OF A PREFERRED EMBODIMENT

Figure 1:
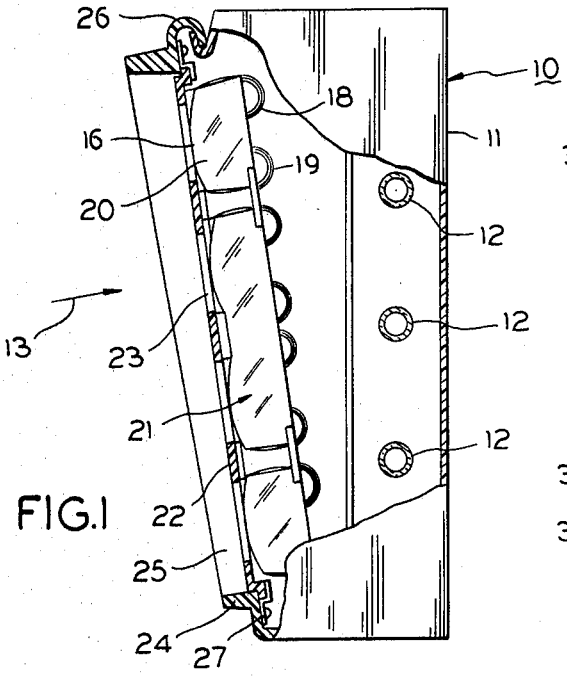
FIG. 1 is an end elevational view of a typical display device in which the new tape restraining means may be embodied, parts of said device being broken away and other parts being shown in section.
Figure 2:
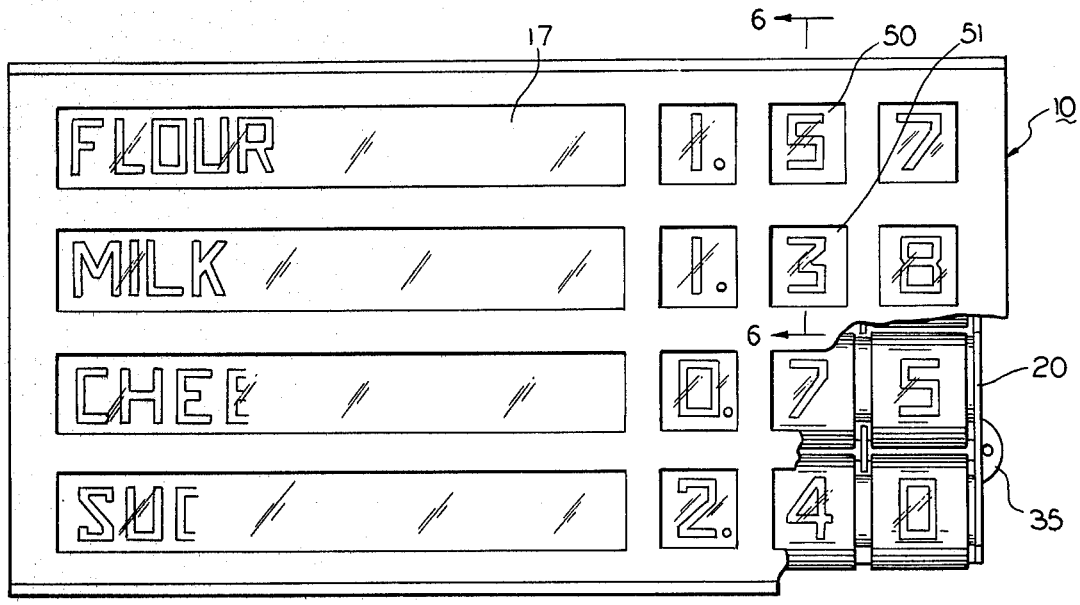
FIG. 2 is a front elevational view as seen from the left side of the device in FIG. 1 wherein a portion of the device which includes the improvements is broken away.
Figure 4:
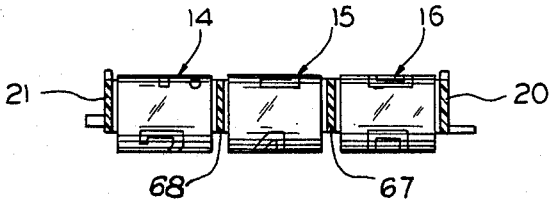
FIG. 4 is a section taken along a line corresponding with 4—4 in FIG. 3.

Referring to FIGS. 1 and 2, a typical sign or display device in which the new tape restraining means may be used is generally designated by the reference numeral 10. The device comprises a housing 11 which has an end wall broken away to show that it is provided with several light sources such as fluorescent lamps 12. Information that is displayed may be viewed by an observer looking generally in the direction of the arrow 13. Information such as price indicia being displayed may be represented by the translucent numbers 1, 5 and 7 on the respective tapes 14, 15 and 16 in FIG. 3.

Transmission of light through the indicia is optional. The indicia are legible as long as there is some contrast between their color or translucence and that of the background.

FIG. 2 shows the price indicia adjacent items to which they relate. The names of the items such as flour, milk and so forth in this example are formed with translucent letters on suitable opaque strips 17 but this part of the display device is not involved with the improved tape restraining means since the indicia are not on movable tapes.

Figure 3:
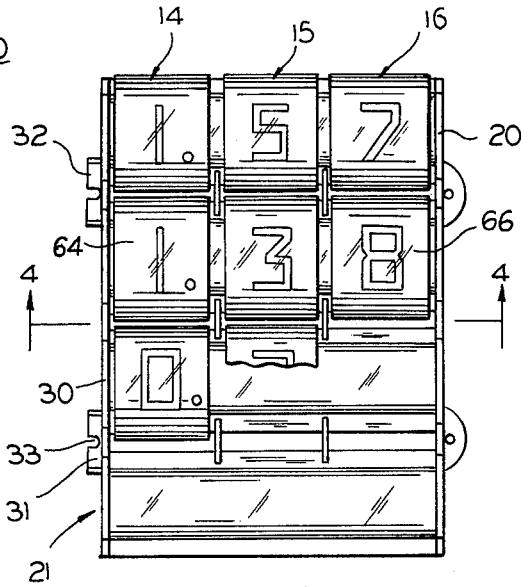
FIG. 3 is a front elevational view of an indicia display assembly of FIG. 1 which includes the improvements.
Figure 5:
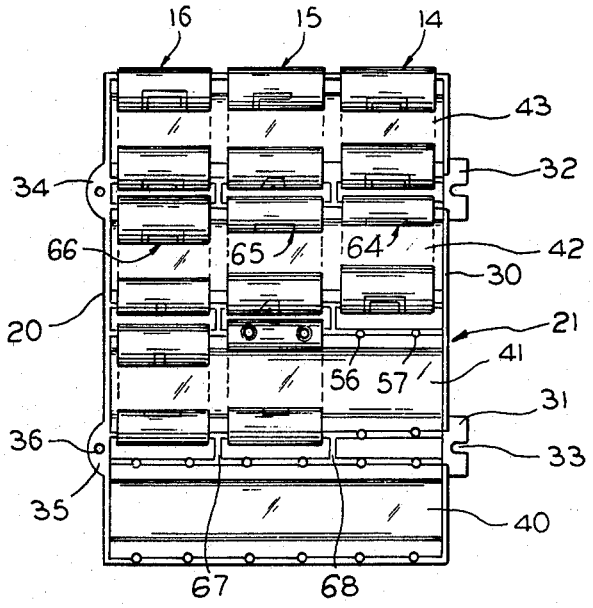
FIG. 5 is a rear view of the assembly shown in FIG. 3 but with some parts removed for the sake of illustration.

In FIG. 1, the end coils of tape 16, for example, involved with the improved restraining means are marked 18 and 19 and are situated on the opposite side of a wall 20 of a frame which is generally designated by the number 21 in FIGS. 3 and 5. In FIG. 1, one may see that the frame 21 may be supported from another frame 22 which serves as a mask in which there are sight openings or windows 23 through which the indicia on the tapes may be viewed. Mask 22 may serve as a support for frame 21 which may be mounted to a member 24 which has a large sight opening 25. Member 24 is supported on the front of housing 11 such as with a long hook 26 or overhang at the top and an inwardly extending tongue 27 at the bottom.

Referring to FIGS. 3 and 5 which show front and rear views of the supporting frame 21 for the several indicia bearing tapes, it will be apparent that the frame has opposite sides or walls 20 and 30 which are preferably molded of a transparent plastic material as part of an unitary frame. At one side 30 of the frame there are flat lateral projections 31 and 32 which lie in the same plane. A typical projection 31 has an open ended slot 32. The other side 20 of the frame also has integral projections 34 and 35. Typical of both projections, projection 35 has a hole 36 in it. Projection 35 on one side of the frame is offset from the level of projection 31 on the other side so that projections of one kind on one frame may be superimposed on projections of the other kind on an adjacent frame and screws passing through holes 36 and slots 33, for example, may be used to effect coupling several frames to display more than the three illustrated rows of indicia.

Spanning between sides 20 and 30 of frame 21 and molded integrally therewith are a set of cross members 40–43 which are generally u-shaped in cross section and which serve to support an equal number of rows of indicia bearing tapes such as those designated generally by the reference numerals 14, 15 and 16 in one row and 64, 65 and 66 in an adjacent row. Note in FIG. 5 that some of the cross members 40 and 41 have integral webs such as 67 and 68 between them for stiffening the frame and for assuring that the end coils of the indicia bearing tapes will be held in alignment.

Figure 6:
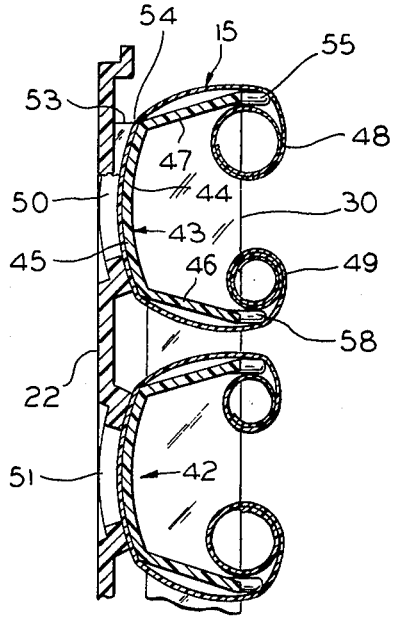
FIG. 6 is a vertical section taken along a line corresponding with 6—6 in FIG. 2.

Refer now to FIG. 6 where two of the generally u-shaped translucent cross members 42 and 43 are shown in section and joined with one of the sides 30 of the frame. A typical cross member 43 has a translucent wall 44 which is convex toward the front. Wall 44 has a smooth front surface 45 with which a portion of an indicia bearing tape 15 is in contact relation. Cross member 43 also has angulated sides 46 and 47 which are integral with front wall 44. Curved portions of tape 15 on opposite sides of wall 44 extend in juxtaposition but in spaced relationship with sides 46 and 47. The self forming coils at the end of tape 15 are marked 48 and 49 in FIG. 6. This figure also shows a portion of the frame or mask 22 which has sight openings or windows typified by those marked 50 and 51 through which the indicia on the tapes 43 and 42 may be observed. Mask 22 also has guide webs 53 extending rearwardly from it which define a small gap 54 or guide slot through which the tape may translate. As indicated earlier, when, for example, it is desired to have a different indicia in a series of indicia on the tape appear in a window the tape is pressed into contact with convex surface 45 of front wall 44 and slid in whichever direction is desired. During translation, more turns of tape are formed in one of the coils 48 or 49 and the number of turns in the other coil are diminished.

It will be evident in FIG. 6 that without the means which are to be described for restraining the end of the tape, the tape might be translated sufficiently for one of the coils such as 48 to be completely used up or uncoiled and the other of the coils such as 49 to contain most of the tape in which case coil 48 would form into a free uncoiled end which might be difficult to feed back or rethread to enable reverse winding again. The manner and means for preventing withdrawal of either end of the tape from its holder will now be described in greater detail.

Note in FIG. 6 that projecting rearwardly from the margin of each of the sides 46 and 47 of the cross member are pin means such as a tongue, not shown, or pairs of lugs or pins. One of the pins projecting from the margin of side 47 in FIG. 6 is marked 55 and its counterpart which is in spaced relationship and behind it in FIG. 6 is not visible therein. However, reference may be made to FIG. 5 where one pair of pins extending from the same margin of the cross member are marked 56 and 57 and are visible because the tape with which they cooperate has been omitted. In FIG. 6 there are also another pair of pins, one of which is marked 58 extending from the rear margin of side 46 of the cross member. Note in FIG. 6 that the rear side of the tape 15 simply runs over the tips of the pins including 55 in one pair and 58 in the other pair without interfering with the coiling and uncoiling process.

Figure 7:
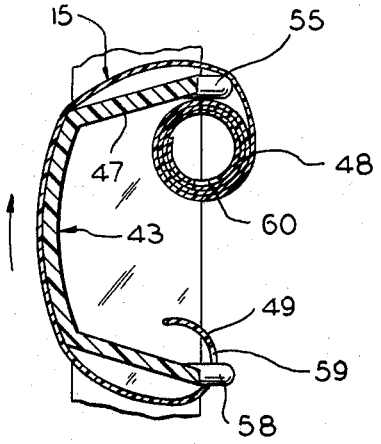
FIG. 7 is a fragmentary section which illustrates the indicia displaying tape in one state of winding.

Refer now to FIG. 7 where a typical translucent cross member 43 and the tape 15 which it supports is shown in isolation and in a condition where the tape has been translated so far that most of it forms coil 48 and the other end 49 is substantially completely uncoiled. In accordance with the invention, tape 15 has a pair of apertures near each end one of which apertures in a pair at one end is marked 59 and is visible in FIG. 7. The centers of the apertures in each pair are laterally spaced by the same distance that the centers of the pairs of cooperating pins 58 are spaced. Hence, when the end 49 is uncoiled to the extent in which it appears in FIG. 7, the inherent resiliency of the precoiled tape causes the apertures to spring over the pins and prevent further translation and withdrawal of the tape end. The other end of the tape is also provided with a pair of apertures near its end region, one of which apertures is marked 60 in FIG. 7. Thus, when coil 48 is nearly completely unwound, apertures in the pair including 60 slip over pins 55 and restrain the tape against further translation.

Figure 8:
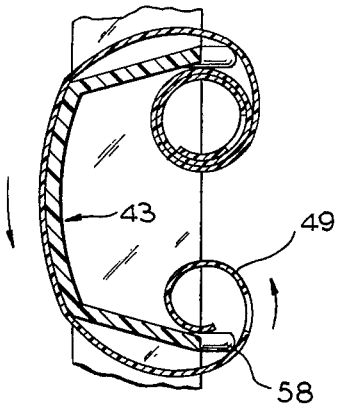
FIG. 8 is similar to FIG. 7 except that it shows the tape in another state of winding.

FIG. 8 shows what happens when the tape is started to be translated in a reverse direction as compared with that in which it was translated in FIG. 7. Assuming that a force is applied to the tape in the general direction of the arrow adjacent convex member 43, the end 49 of the tape springs off of pins 58 and a coil 49 begins to form as illustrated in that figure. Thus, engagement and restraint of the tape end is automatic and requires no attention by the operator and release of the tape for reverse winding is also automatic and requires no attention by the operator other than that which is devoted to translating the tape by pressing it with a finger.

Although it has been found preferable to use a pair of pins which cooperate with a pair of laterally spaced apertures in the tape end regions for automatically effecting restraint and release of the tape end, it will be appreciated by those skilled in the art that reasonably good results may be obtained by using only one pin cooperating with one aperture in the tape or a projection in the form of a narrow tongue that cooperates with a slotted hole or aperture in the tape might also be used. All projections such as single and multiple pins, lugs and tongues in combination with suitably shaped holes in the tape are intended to be embraced by the combination of pin means and aperture means as used herein. Although a preferred embodiment of the invention has been described in considerable detail, such description is intended to be illustrative rather than limiting, for the invention may be variously embodied and is to be limited in scope only by interpretation of the claims which follow.

I claim:

1. In a display device:

a tape bearing indicia and having front and rear sides, said tape having the property of tending to form coils at opposite ends when unrestrained, said tape having aperture means near its opposite ends, a member having a rigid front wall providing a surface of predetermined length for supporting said tape in a region intermediate its ends and to present the front of said tape for observation of said indicia and for enabling said tape to be pressed against said rigid surface and slid to translate said tape.

first and second pin means spaced from each other on opposite ends of said rigid front surface length, said pin means projecting generally rearwardly away from said rigid front surface and having tips, a portion of said tape beyond each end of the length of said rigid surface being disposed for sliding over said tips such that the end portions of said tape may form coils, respectively, in the space between said first and second pin means, each of said first and second pin means comprising a pair of pins which are spaced apart from each other in the crosswise direction of said tape and said respective aperture means are a pair of apertures which are spaced apart correspondingly with said pair of pins, translation of said tape in one direction until one of its end portions is substantially uncoiled resulting in said aperture means near said one end slipping onto said pin means to prohibit positively further translation of the tape in said one direction and translation of said tape oppositely of said one direction resulting in said aperture means slipping off of said pin means to enable said one end portion to recoil.

2. The device as in claim 1 wherein:

said member is generally u-shaped in cross section and said front wall is light transmissive and said member includes side walls joined, respectively, with opposite sides of said front wall, said side walls extending rearwardly from said front wall and terminating with their margins exposed, said pin means projecting from said margins, respectively.

3. The device as in claim 2 wherein said pin means project in a direction that is substantially normal to said surface.

4. The device as in claim 2 having:

a plurality of said u-shaped members each of which is long enough for more than the width of one tape to be disposed thereon with space between the edges of adjacent tapes, said members being arranged in substantial parallelism with each other, frame means integral with and surrounding said members and web means spanning between members and integral therewith, said web means in conjunction with said frame maintaining the tapes in predetermined paths.

* * * * *